US005362244A

United States Patent [19]

Hanson et al.

[11] Patent Number: 5,362,244

[45] Date of Patent: Nov. 8, 1994

[54] SOCKET HAVING RESILIENT LOCKING TABS

[75] Inventors: Theodore G. Hanson, Prospect; John A. Rinaldi, Waterbury, both of Conn.

[73] Assignee: The Whitaker Corporation, Wilmington, Del.

[21] Appl. No.: 109,231

[22] Filed: Aug. 19, 1993

[51] Int. Cl.[5] ..... H01R 9/09

[52] U.S. Cl. ..... 439/82; 439/856

[58] Field of Search ..... 439/82, 83, 844, 856, 439/857

[56] References Cited

U.S. PATENT DOCUMENTS

| | | | |
|---|---|---|---|
| 4,050,772 | 9/1977 | Birnholz et al. | 339/220 R |
| 4,175,810 | 11/1979 | Holt et al. | 339/17 C |
| 4,415,212 | 11/1983 | DePillo | 339/17 C |
| 4,822,288 | 4/1989 | Conley | 439/84 |
| 4,934,967 | 6/1990 | Marks et al. | 439/856 |
| 5,135,403 | 8/1992 | Rinaldi | 439/82 |
| 5,147,227 | 9/1992 | Yurko | 439/82 X |
| 5,169,322 | 12/1992 | Frantz et al. | 439/82 |
| 5,209,681 | 5/1993 | Brown | 439/83 X |

FOREIGN PATENT DOCUMENTS 0398233 11/1990 European Pat. Off. ..... 439/82

*Primary Examiner*—Eugene F. Desmond

*Attorney, Agent, or Firm*—Robert J. Kapalka

[57] ABSTRACT

A socket for receiving a lead of an electronic component comprises a socket body having a tubular body portion and a lead gripping portion. The tubular body portion defines a reception zone for receiving the lead of the electronic component along a lead receiving axis. The lead gripping portion has angularly spaced apart spring fingers which are separated by gaps. The spring fingers extend from the tubular body portion and converge inwardly toward the lead receiving axis to define a constriction for frictionally gripping the lead. Segments of the tubular body portion which are adjacent to and axially aligned with the gaps between the spring fingers are bent outwardly. The outwardly bent segments define retention barbs which are engageable with a wall of the hole in the substrate to retain the socket in the substrate.

5 Claims, 4 Drawing Sheets

Fig. 7
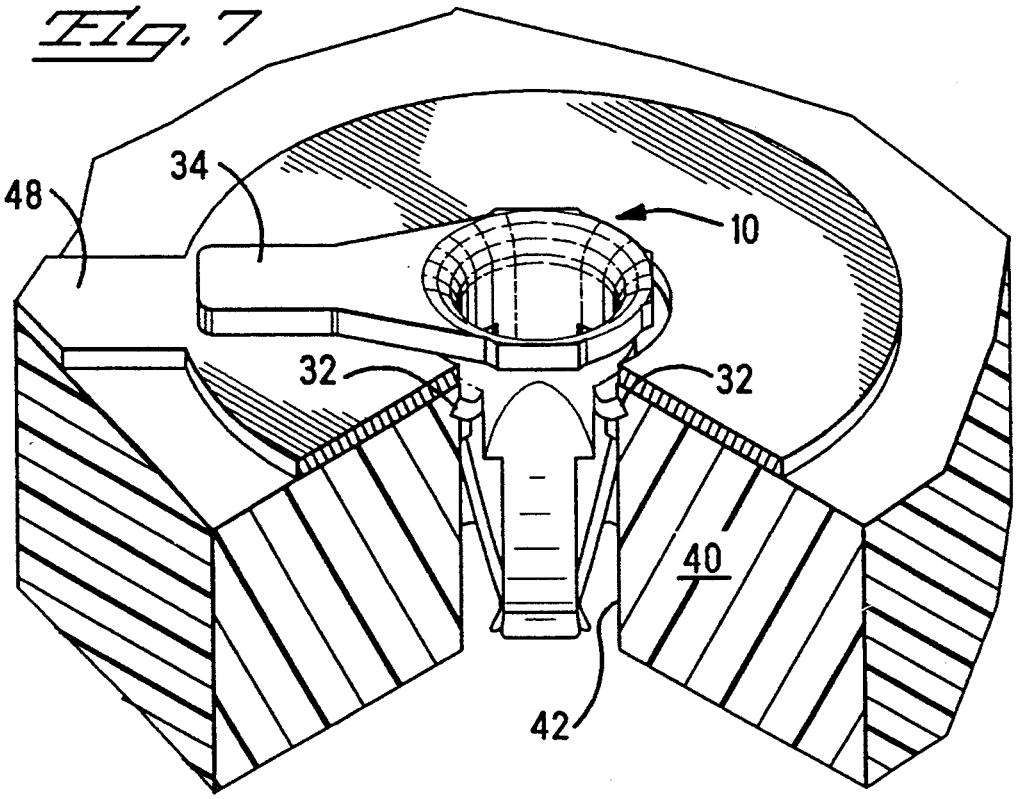
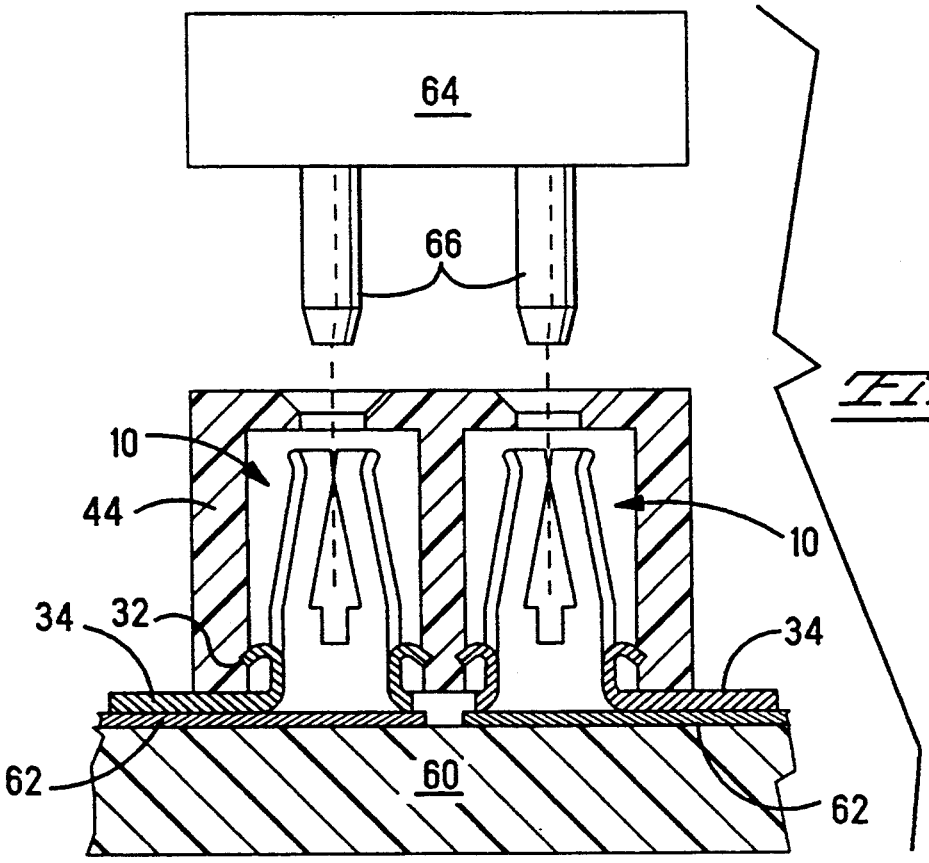
Fig. 8

SOCKET HAVING RESILIENT LOCKING TABS

FIELD OF THE INTENTION

The invention relates to an electrical socket having resilient locking tabs for engaging a wall of a hole in a substrate.

BACKGROUND OF THE INVENTION

U.S. Pat. No. 5,169,322 discloses an electrical connector comprising an insulative strip having electrically conductive receptacles, or sockets, for receiving conductive pins, or leads, of an electronic component. The sockets are integral tubular members having a cylindrical body portion and depending spring fingers which converge inwardly from the cylindrical body, the fingers being resiliently deflected upon receipt of a lead in the socket. The sockets further have solder tabs for electrical connection with circuit paths on a circuit board. In one embodiment, the sockets are frictionally retained in the insulative strip by holes in the insulative strip having a flat side to compress against the cylindrical body portion of the socket. This retention means requires that dimensions of the sockets and the holes be held to close tolerances to ensure a snug fit of the sockets in the holes. In another embodiment, an outer sleeve surrounds the cylindrical body portion with an interference fit, and a top of the sleeve resides adjacent to a bottom facing surface of the insulative strip to prevent withdrawal of the socket from the strip. This embodiment is relatively expensive to produce due to additional cost of manufacturing the outer sleeve and additional assembly required to install the outer sleeve. There is a need for a socket which is less expensive to manufacture and simpler to install than prior art electrical sockets.

SUMMARY OF THE INVENTION

The invention provides a socket insertable in a hole in a substrate for receiving a lead of an electronic component. The socket comprises a socket body defining a lead receiving axis and having a tubular body portion and a lead gripping portion. The tubular body portion defines a reception zone for receiving the lead of the electronic component. The lead gripping portion defines a constriction for frictionally gripping the lead. Angularly spaced apart segments of the tubular body portion are bent outwardly to define retention barbs engageable with a wall of the hole in the substrate to retain the socket in the substrate.

In a preferred embodiment, the lead gripping portion has spring fingers which extend from the tubular body portion, the spring fingers being defined by angularly spaced apart gaps in a wall of the socket body. The outwardly bent segments of the tubular body portion are adjacent to and axially aligned with the gaps. At least some of the spring fingers converge inwardly toward the lead receiving axis to define the constriction for frictionally gripping the lead.

The socket may also include a solder tab extending from the tubular body portion for electrical connection with a circuit path.

The present invention is particularly suitable for very small size sockets, e.g., on the order of 0.1 inch in length.

BRIEF DESCRIPTION OF THE DRAWINGS

There are shown in the drawings the embodiments of the invention that are presently preferred. It should be understood, however, that the invention is not limited to the precise arrangements and instrumentalities shown in the drawings, wherein:

FIG. 7 is a view of the socket of FIG. 5 in a plated through-hole.

FIG. 8 is a partial cross-sectional view of sockets disposed in a connector housing, and an electronic device having leads to be received in the sockets.

DETAILED DESCRIPTION OF THE PREFERRED EMBODIMENT

Figure 1:
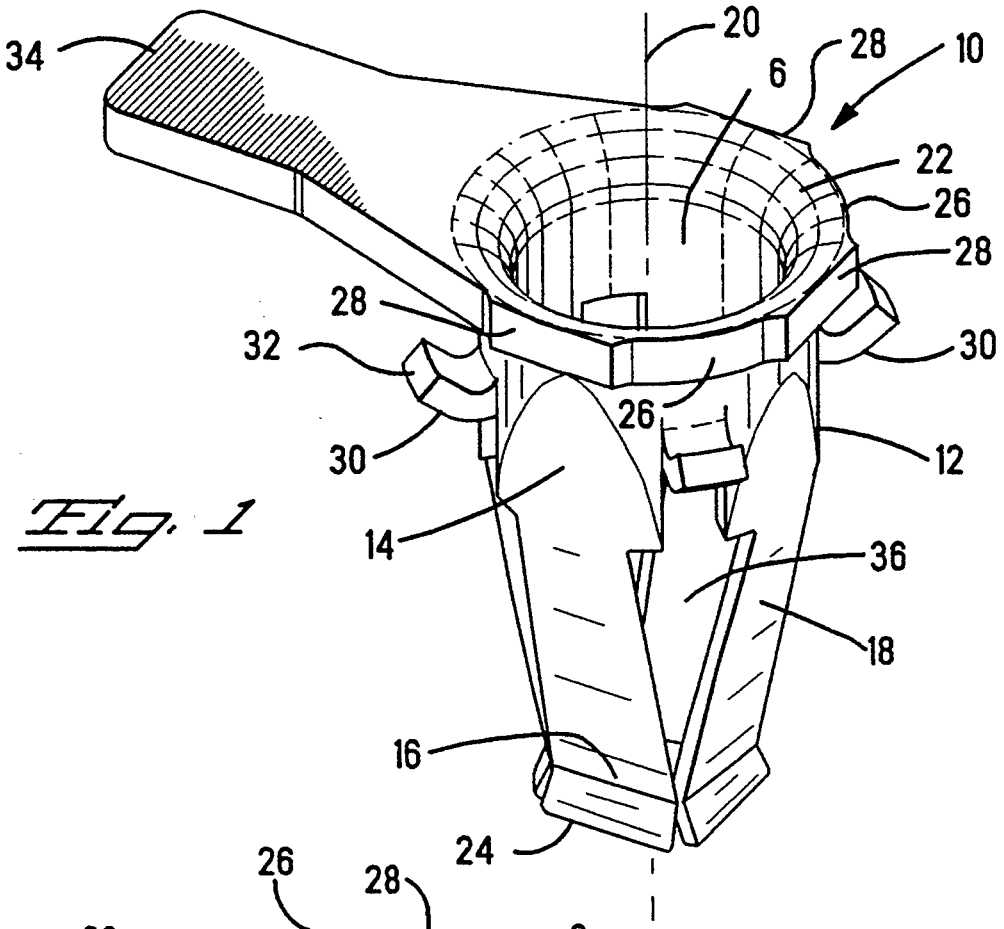
FIG. 1 is a top perspective view of a socket having resilient locking tabs and a solder tab, according to the invention.
Figure 2:
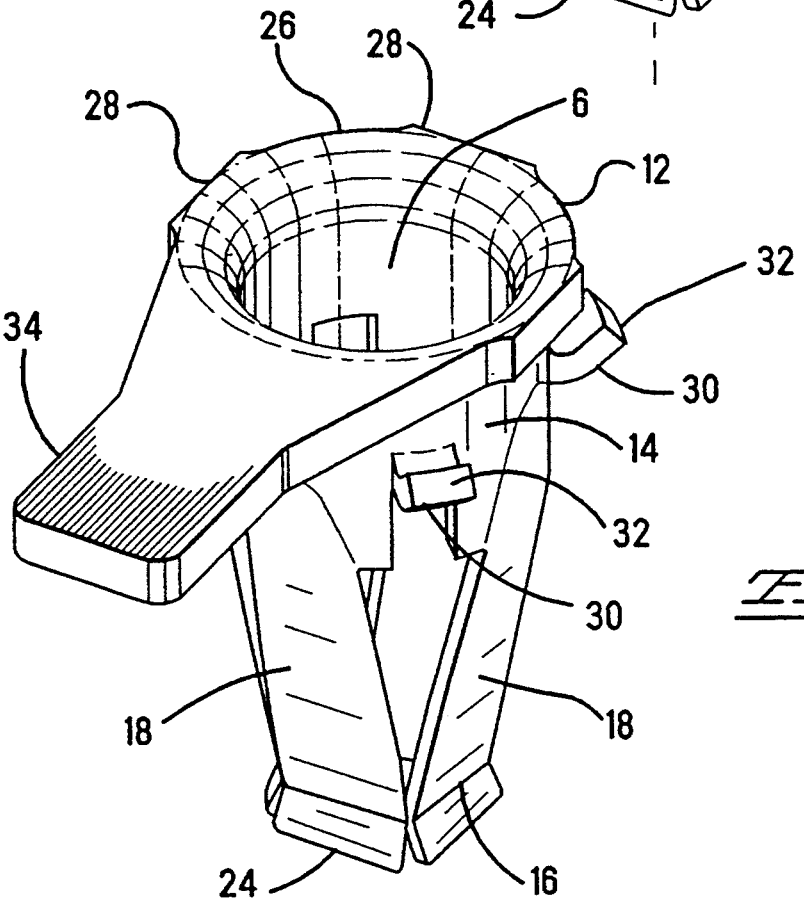
FIG. 2 is a view of the socket of FIG. 1, rotated 90° counter-clockwise.
Figure 3:
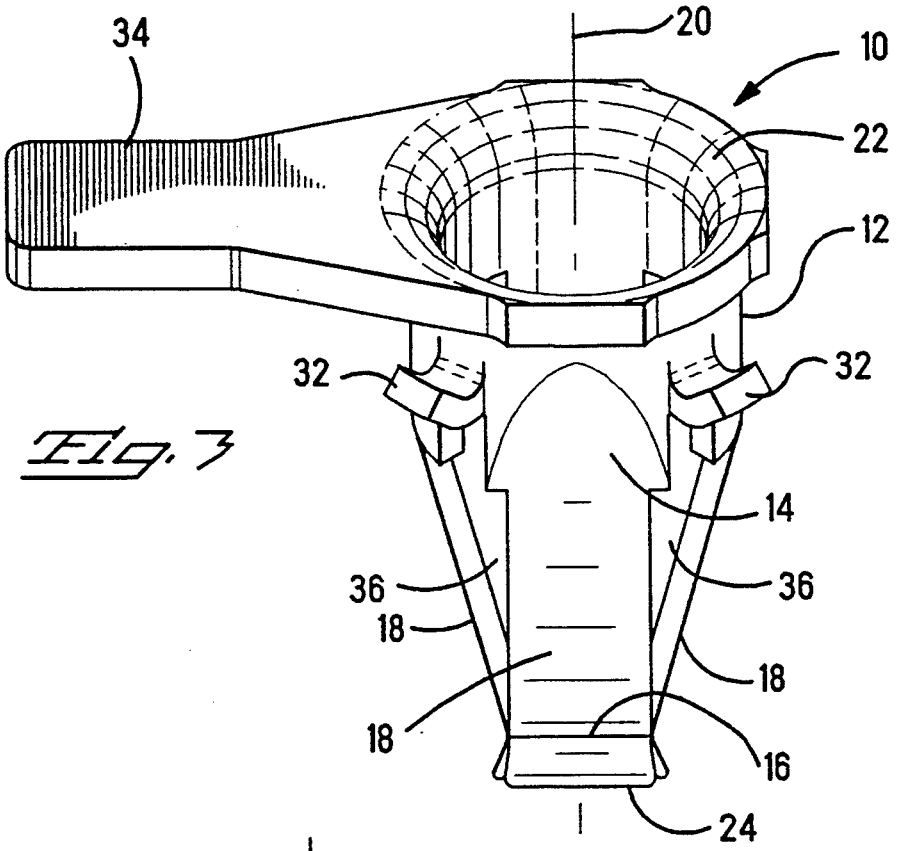
FIG. 3 is a view of the socket from a different angle.
Figure 4:
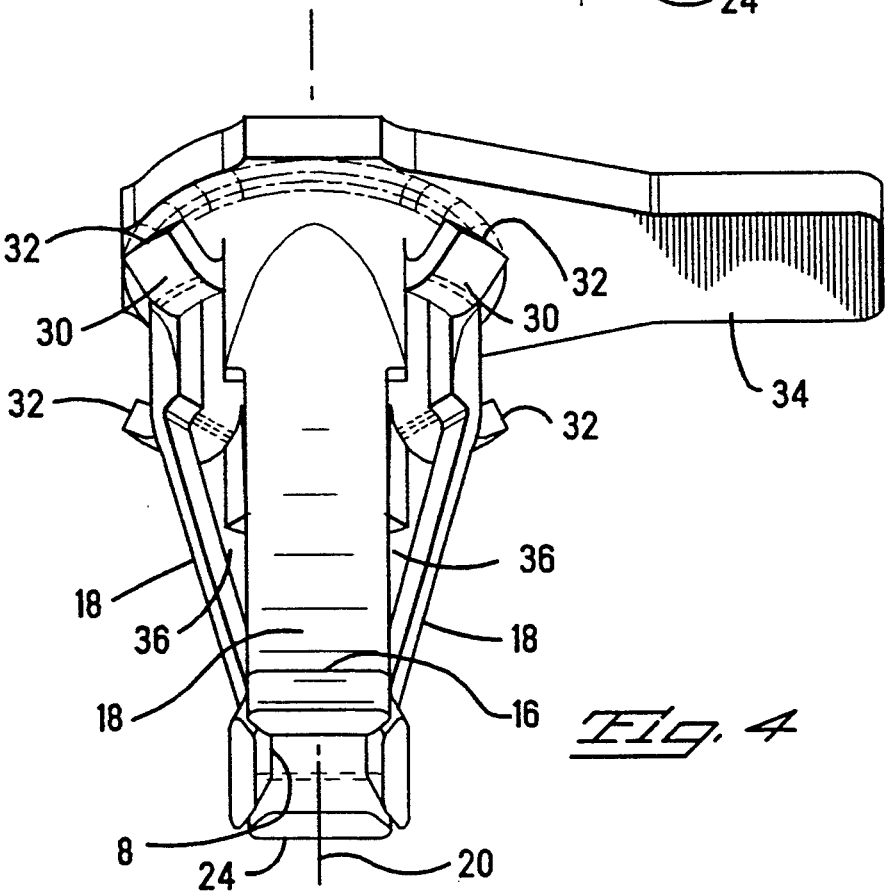
FIG. 4 is a bottom perspective view of the socket.

With reference to FIGS. 1–4, a socket 10 according to the invention comprises a socket body 12 defining a lead receiving axis 20 and having a tubular body portion 14 and a lead gripping portion 16. The socket body 12 is manufactured by cold drawing a strip of material in a conventional manner so as to provide an integrally circumferentially continuous tubular body portion 14. An interior of the tubular body portion 14 defines a reception zone 6 for receiving a lead (not shown) of an electronic component. In a preferred embodiment as shown in the drawings, the reception zone 6 is substantially circular in cross-section, although non-circular cross-sections such as oval or square are possible alternative configurations and are considered to be within the scope of the invention.

The lead may be introduced into the socket through either one of ends 22, 24 of the socket body 12, as determined by the particular arrangement of the socket, substrate, and electronic component, and each of the ends 22, 24 are preferably beveled, radiused or flared to assist in guiding the lead into the socket. The lead is directed along the lead receiving axis 20, and a portion of the lead resides within the lead gripping portion 16 which defines a constriction 8 for frictionally gripping the lead.

In a preferred embodiment as shown in the drawings, the lead gripping portion 16 includes angularly spaced apart spring fingers 18 extending from the tubular body portion 14, the spring fingers being defined by removing material from the socket body 12 to define angularly spaced apart gaps 36 between the spring fingers 18 in the socket body 12. The spring fingers 18 converge inwardly toward the lead receiving axis 20 to define the constriction 8.

According to the invention, a number of angularly spaced apart segments 30 of the body portion 14 are bent outwardly away from the lead receiving axis 20. In the preferred embodiment, the segments 30 are adjacent to and axially aligned with the gaps 36. Outer ends of the segments 30 define retention barbs 32 which are engageable with a wall of a hole in a substrate.

As shown in FIGS. 1–4, the socket 10 has a solder tab 34 for electrical connection with a conductive pad of an electrical circuit on a circuit board. The solder tab 34 is given a solder coating which is reflowed in a heating operation and subsequently re-solidified to provide a secure solder joint with the conductive pad.

Figure 5:
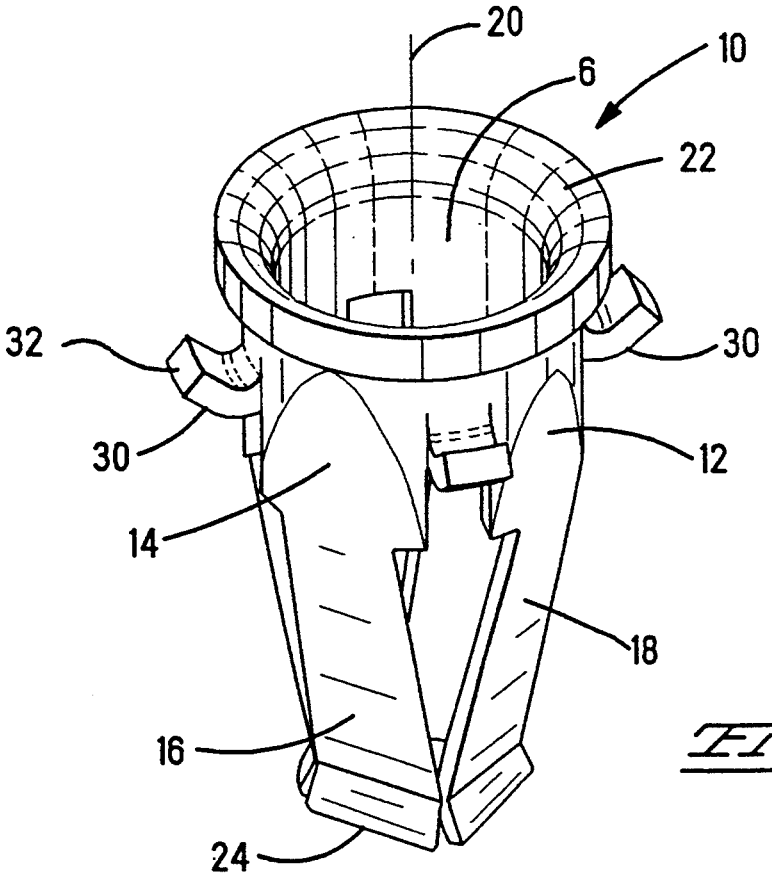
FIG. 5 is a top perspective view of a socket having resilient locking tabs according to the invention, without a solder tab.

FIG. 5 illustrates an alternative embodiment which is the same as the embodiment of FIGS. 1–4, except the socket does not have a solder tab.

Figure 6:
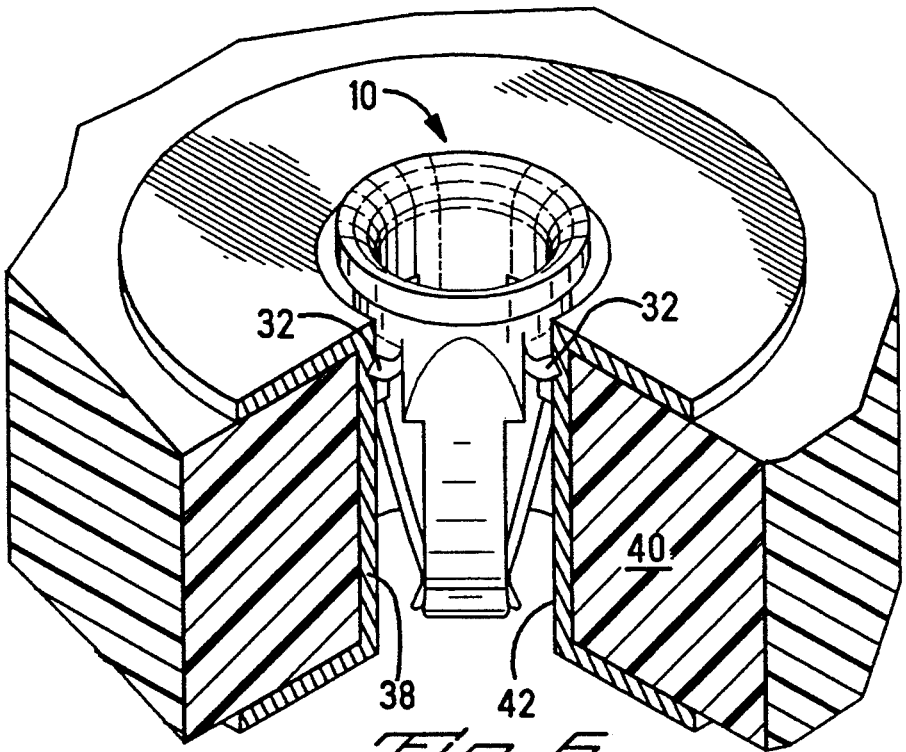
FIG. 6 is a view of the socket of FIG. 1 in a through-hole in a substrate.

Referring now to FIGS. 6 and 7, the socket 10 is suitable for insertion in a hole 42 in a substrate such as circuit board 40. The hole 42 is dimensioned to provide an interference fit with the retention barbs 32 when the socket is inserted in the hole, the retention barbs 32 in their free state defining a periphery having a dimension slightly larger than the hole dimension. The segments 30 are resiliently deflectable to permit forced insertion of the socket 10 in the hole 42, whereby the barbs 32 engage in and frictionally grip the wall of the hole 42. The hole 42 may be either plated or unplated, as shown in FIGS. 6 and 7, respectively. For the socket disposed in the plated through-hole as shown in FIG. 6, the socket is electrically connected to a circuit on the circuit board by engagement of the barbs 32 in electrically conductive hole plating 38. For the socket disposed in the unplated through-hole as shown in FIG. 7, the socket is electrically connected to a circuit path by soldering of the tab 34 to conductive pad 48.

Referring now to FIG. 8, the socket 10 may be advantageously employed in a substrate such as electrical connector 44 which houses a plurality of the sockets 10. The connector 44, which is made from an insulative material, is mounted on a circuit board 60. The sockets 10 have the solder tabs 34 which are soldered to conductive pads 62 on the circuit board 60 for electrical connection with circuit paths on the circuit board. The sockets 10 receive leads 66 of electronic device 64, thereby permitting easy removal of the electronic device 64 from the circuit board.

A socket according to the invention has the advantages of simple yet rugged unitary construction. Resiliently deflectable retention barbs integral with the socket body are better able to accommodate dimensional tolerances of holes in which the socket will reside. The socket is more economical to produce than prior art two-piece sockets.

The invention having been disclosed, a number of variations will now become apparent to those skilled in the art. Whereas the invention is intended to encompass the foregoing preferred embodiments as well as a reasonable range of equivalents, reference should be made to the appended claims rather than the foregoing discussion of examples, in order to assess the scope of the invention in which exclusive rights are claimed.

We claim:

1. A socket insertable in a hole in a substrate for receiving a lead of an electronic component, the socket comprising:

a socket body defining a lead receiving axis and having a tubular body portion and a lead gripping portion, the tubular body portion defining a reception zone for receiving the lead, the lead gripping portion defining a constriction for frictionally gripping the lead, the tubular body portion being integrally circumferentially continuous and having angularly spaced apart segments which are bent outwardly to define retention barbs engageable with a wall of the hole in the substrate to retain the socket in the substrate.

2. The socket according to claim 1, wherein the lead gripping portion includes spring fingers extending from the tubular body portion, and the constriction is defined by at least some of the spring fingers converging inwardly toward the lead receiving axis.

3. The socket according to claim 2, wherein the spring fingers are defined by angularly spaced apart gaps in a wall of the socket body.

4. The socket according to claim 3, wherein the outwardly bent segments of the tubular body portion are adjacent to and axially aligned with the gaps.

5. The socket according to claim 1, further comprising a solder tab extending from the tubular body portion for electrical connection with a circuit path.

* * * * *